US011478030B2

(12) United States Patent
Olivares Velasco et al.

(10) Patent No.: US 11,478,030 B2
(45) Date of Patent: Oct. 25, 2022

(54) PROTECTIVE HEADBAND

(71) Applicant: 2ND SKULL, INC., Pittsburgh, OH (US)

(72) Inventors: Federico Olivares Velasco, Cranberry Township, PA (US); Alberto Maraña Jurado, Seville (ES); Juan Solano Leiva, Seville (ES)

(73) Assignee: 2nd Skull, Inc., Pittsburgh, PA (US)

( * ) Notice: Subject to any disclaimer, the term of this patent is extended or adjusted under 35 U.S.C. 154(b) by 117 days.

(21) Appl. No.: 16/821,177

(22) Filed: Mar. 17, 2020

(65) Prior Publication Data

US 2020/0297052 A1 Sep. 24, 2020

Related U.S. Application Data

(60) Provisional application No. 62/819,796, filed on Mar. 18, 2019.

(51) Int. Cl.
*A41D 20/00* (2006.01)
*A41D 13/015* (2006.01)

(52) U.S. Cl.
CPC ..... *A41D 20/00* (2013.01); *A41D 13/015* (2013.01)

(58) Field of Classification Search
CPC ..... A41D 20/00; A41D 13/015; A42B 1/08
See application file for complete search history.

(56) References Cited

U.S. PATENT DOCUMENTS 4,646,367 A * 3/1987 El Hassen ..... A42B 3/00 2/171
4,947,488 A * 8/1990 Ashinoff ..... A42B 3/00 2/181
5,963,989 A * 10/1999 Robertson ..... A41D 20/00 2/171
6,397,399 B1 * 6/2002 Lampe ..... A42B 1/008 2/171.2
6,438,761 B1 * 8/2002 McGarrity ..... A42B 3/00 2/171
8,789,212 B2 * 7/2014 Cleva ..... A42B 1/08 2/413
2005/0193477 A1 9/2005 Penny
2015/0173666 A1 * 6/2015 Smith ..... A61B 5/682 600/301
2016/0302500 A1 10/2016 Johnston
2017/0332715 A1 11/2017 Abraham

FOREIGN PATENT DOCUMENTS

WO 2005000057 A2 1/2005

OTHER PUBLICATIONS

Young, Lee; International Search Report and Written Opinion of the International Searching Authority, issued in International Application No. PCT/US2020/023107; dated Jun. 15, 2020; 9 pages.

* cited by examiner

*Primary Examiner* — Tajash D Patel
(74) *Attorney, Agent, or Firm* — Ulmer & Berne LLP

(57) ABSTRACT

A headband is provided which has a fabric layer defining pockets, padding layers positioned circumferentially around the headband in the pockets, and an impact panel. The impact panel is positioned to be proximate to the forehead of a wearer of the headband. One of the padding layers is positioned behind the impact panel, such that the padding layer is positioned between the impact panel and the forehead of a wearer.

20 Claims, 10 Drawing Sheets

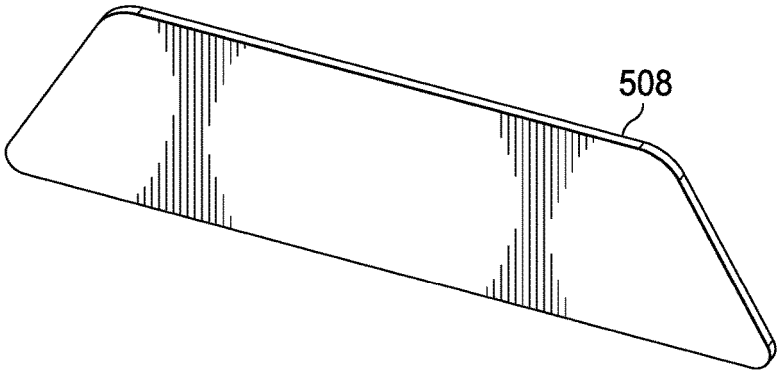
FIG. 8
FIG. 9
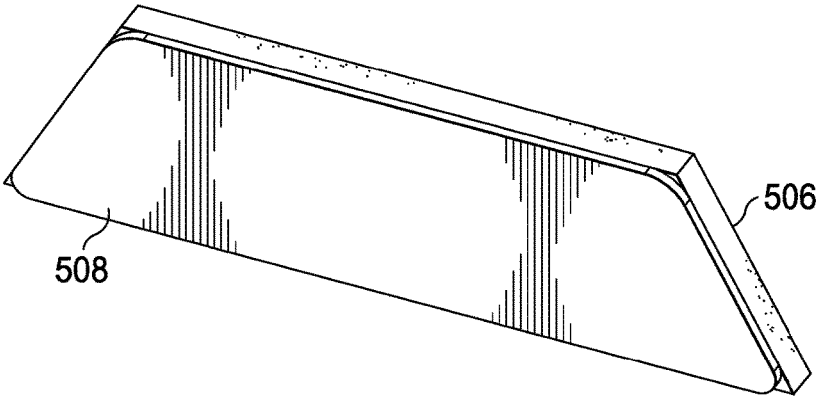
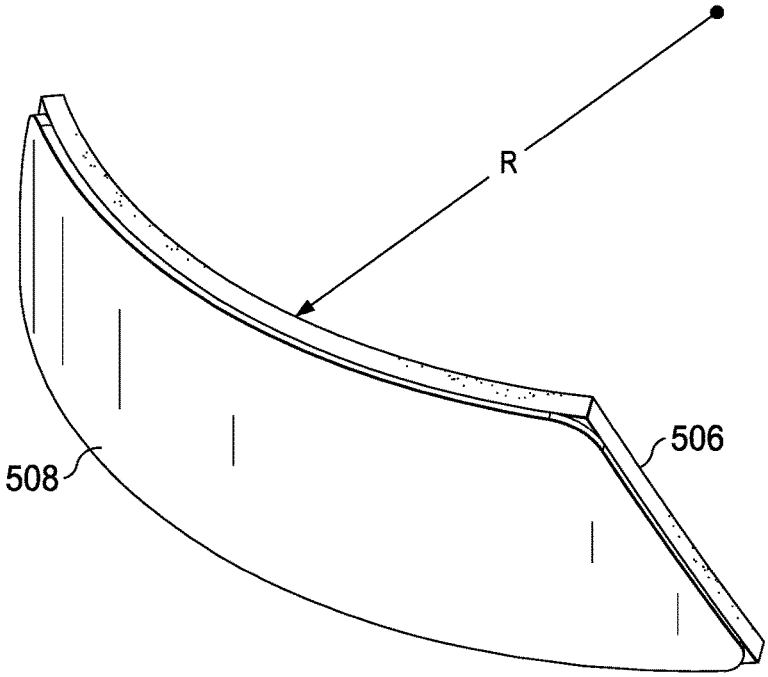
FIG. 10

PROTECTIVE HEADBAND

CROSS-REFERENCE TO RELATED APPLICATIONS

This application claims the benefit of U.S. provisional patent application Ser. No. 62/819,796, filed on Mar. 18, 2019, entitled PROTECTIVE HEADBAND, the disclosure of which is incorporated herein by reference in its entirety.

TECHNICAL FIELD

The systems and methods described below relate generally to the field of head protection. More particularly, the systems and methods relate to headbands that can be worn during sporting, or athletic, or other physical endeavors.

BACKGROUND

Then an individual participates in contact sports activities such as football, lacrosse, hockey, soccer, rugby, basketball, volleyball and the like, or other physical activities, such as skiing, skateboarding, and the like, it is common that parts of the individual's body are subject to impact and other physical contact. Various attempts have been made to provide padding as a means of protecting the individual during such activities. Conventional protective equipment can include helmets, shoulder pads, thigh pads, and shin pads.

BRIEF DESCRIPTION OF THE DRAWINGS

The present disclosure will be more readily understood from a detailed description of some example embodiments taken in conjunction with the following figures:

FIG. 8 shows an impact panel in accordance with one non-limiting embodiment.

FIGS. 9-10 show the impact panel of FIG. 8 in combination with an example padding panel in accordance with one non-limiting embodiment.

DETAILED DESCRIPTION

Figure 1:
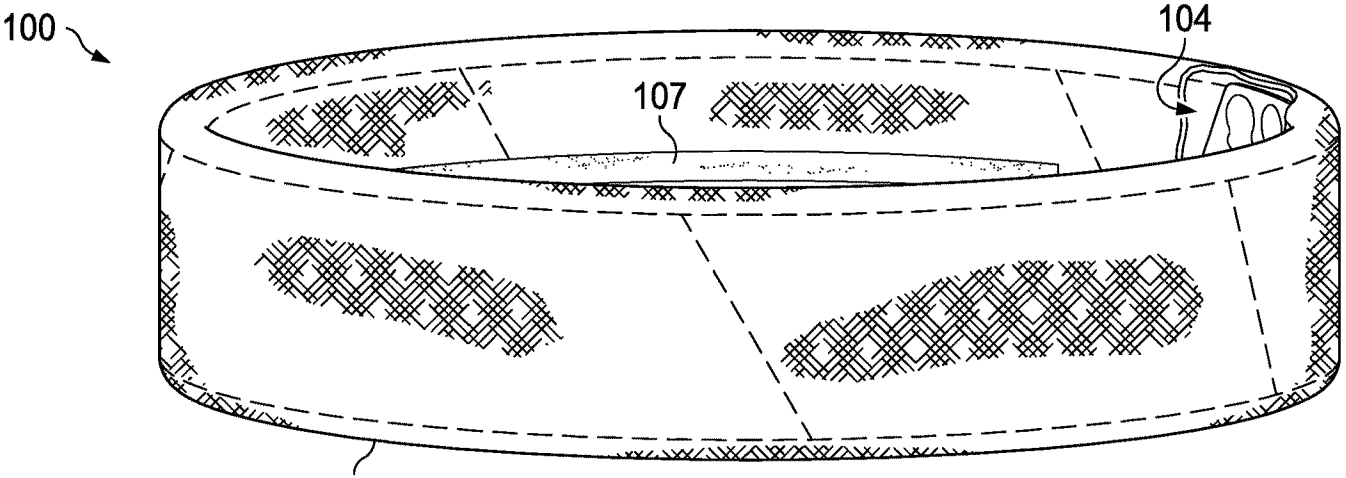
FIG. 1 is an isometric view of a headband in accordance with one non-limiting embodiment.

Various non-limiting embodiments of the present disclosure will now be described to provide an overall understanding of the principles of the structure, function, and use of the headbands disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

The presently disclosed embodiments are generally directed to headband, headband systems, methods of using a headband, and methods of manufacturing headbands. Such systems and methods may be implemented in a wide variety of contexts and applications. In one example embodiment, the headband is compressive so that it can be retained on a user's head without the use of a securing strap, such as a hook-and-loop strap. In other embodiments, an adjustment strap can be used to help secure the headband in place. The headbands can be constructed with one or more layers, sections, or pockets of impact absorbing or impact dissipating materials, referred to generally herein as padding. The particular type of padding can vary based on a variety of factors, such as style of headband, sporting or athletic application, type of user, size of headband, and so forth. As described in more detail below, in some embodiments, the headband can have multiple layers, including an inner layer, a middle layer, and an outermost layer. The middle layer can comprise the padding.

The headband can also include a rigid portion which can be positioned proximate to a user's forehead when worn. In some example embodiments, the headband can be washable without necessarily removing the padding layer from the headband. The headband can also have breathable characteristics, sweat wicking characteristics, or other comfort related characteristics, such as vents. The headband can have water resistant or water repellant qualities. In some embodiments, the headband can include an anti-bacterial agent, anti-microbial agent, anti-odor agent, or other deodorizing or sanitizing compounds. In some embodiments, the headband is configured to provide protection against ultraviolet rays using any suitable techniques, such as chemical treatments, construction techniques, materials, and so forth. Further, the headband can be include anti-slip features, such as a silicone grip element, to aid in maintaining the placement of the headband on the wearer's head.

The headband described herein can be sized to accommodate different ages of users. In one example embodiment, a child's "one size fits all" headband is sized to fit children and an adult's "one size fits all" headband is sized to fit adults. As described in more detail below, elastic components incorporated into the headband can aid in maintaining the headband on a user's head while also allowing the headband to accommodate different sized heads. In some embodiments, headbands can be manufactured in different sizes (small, medium, large, x-large, and so forth). In some embodiments, the headband may be selectively adjustable to accommodate different head sizes.

Reference throughout the specification to "various embodiments," "some embodiments," "one embodiment," "some example embodiments," "one example embodiment," or "an embodiment" means that a particular feature, structure, or characteristic described in connection with the embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Figure 2:
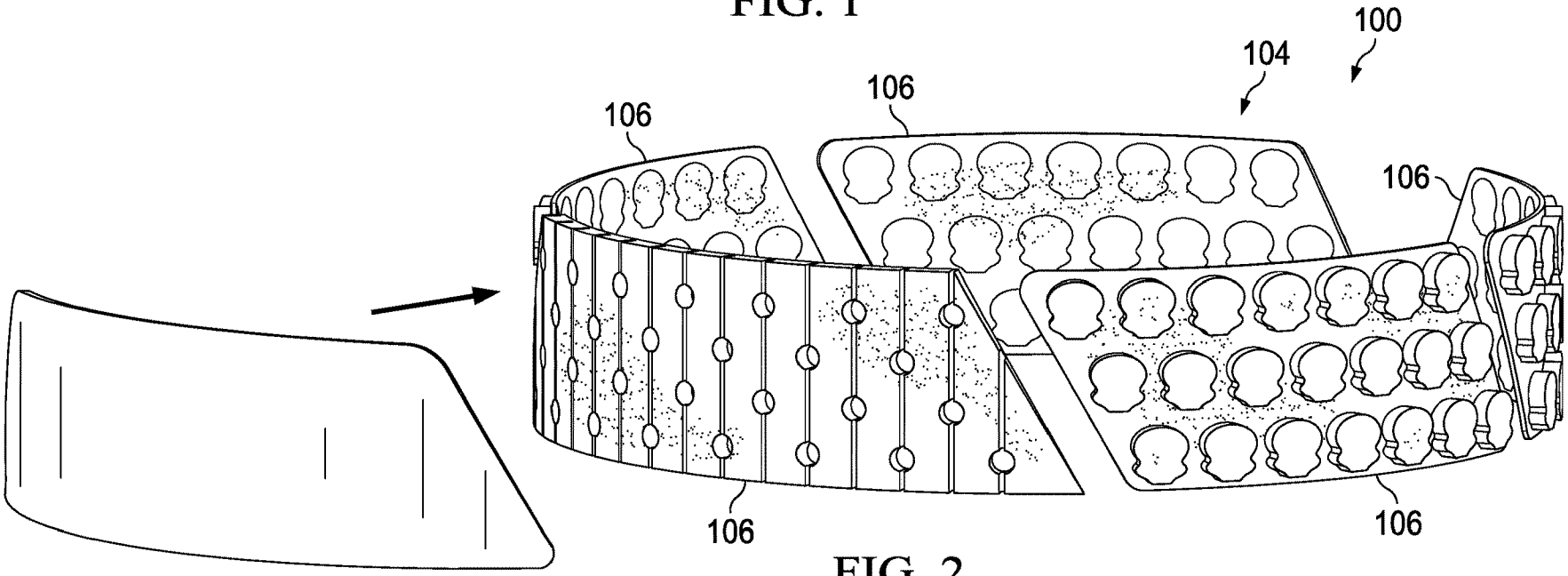
FIG. 2 is an isometric exploded view of the headband of FIG. 1 with portions removed for clarity.
Figure 3:
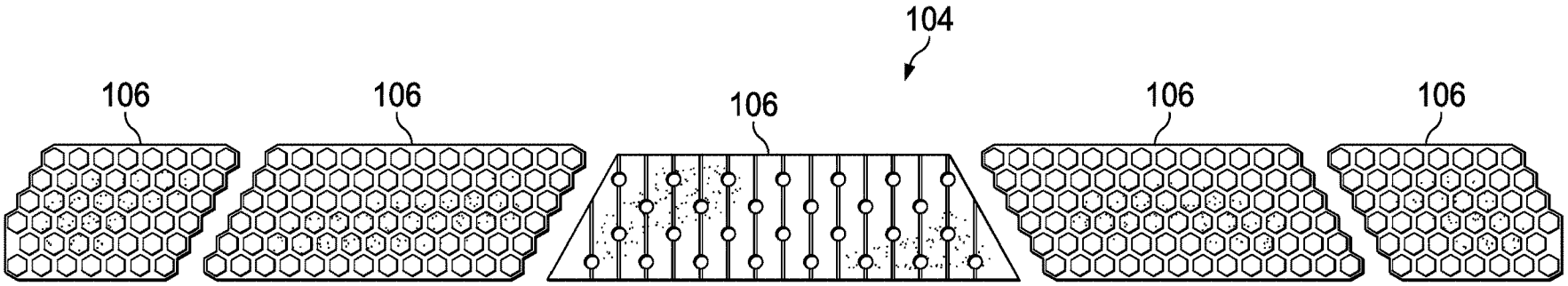
FIG. 3 depicts an example padding layer of the headband of FIG. 1 in a flat, laid out state.
Figure 4:
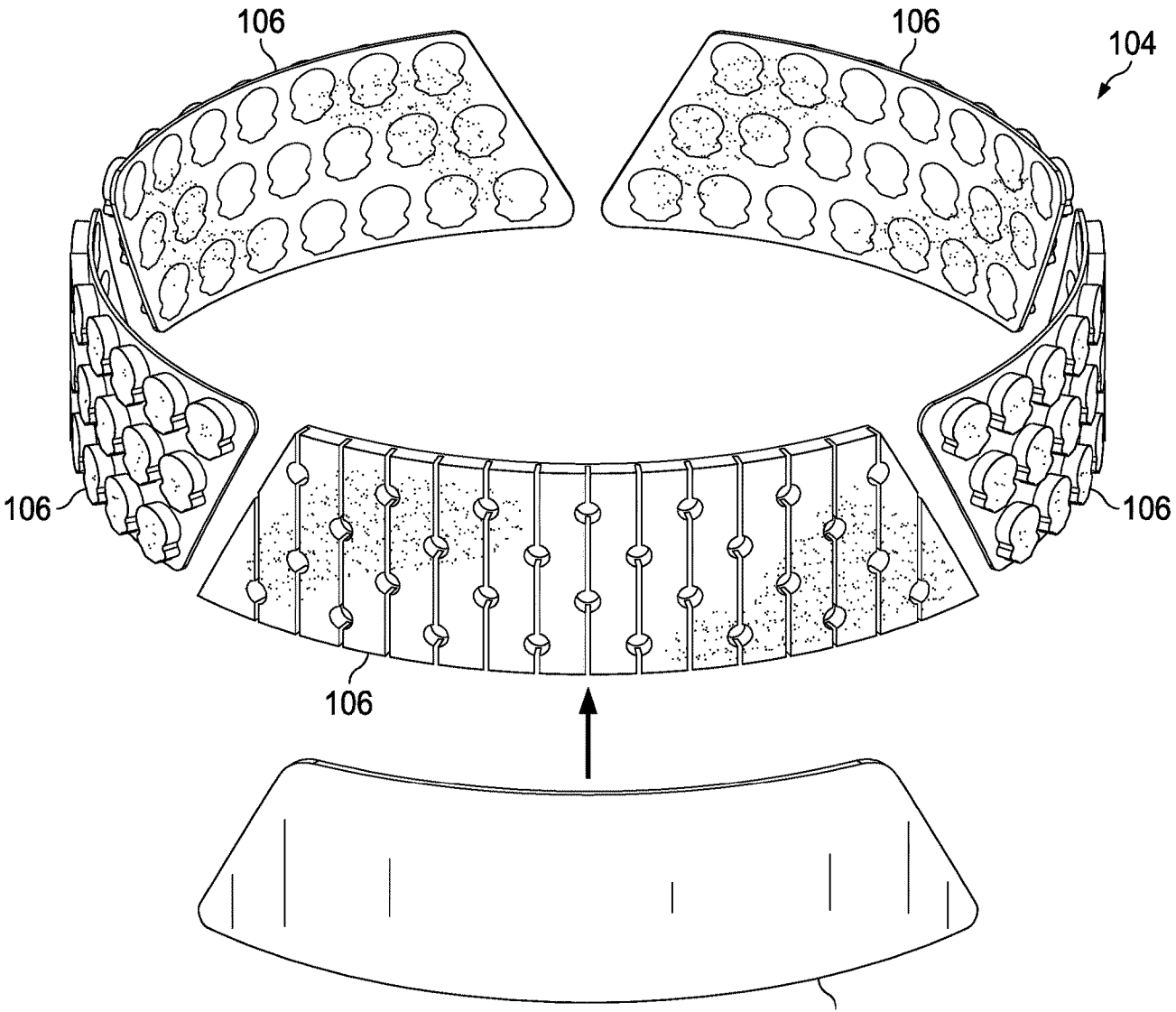
FIG. 4 is another exploded isometric view of the headband of FIG. 1 with portions removed for clarity.

FIGS. 1-4 show an example headband 100 in accordance with one non-limiting embodiment. FIG. 1 is an isometric view of the headband 100. FIG. 2 is an exploded isometric view of the headband 100 with portions removed for clarity. FIG. 3 depicts an example padding layer 104 of the headband 100 in a flat, laid out state. FIG. 4 is another exploded isometric view of the headband 100 with portions removed for clarity. Generally, the headband 100 can have an outermost layer 102 that at least partially surrounds a padding layer 104. In some configurations, portions of the padding layer 104 may be visible or otherwise exposed. In other embodiments, the padding layer 104 is wholly surrounded or covered by the outermost layer 102. The padding layer 104 can be formed of a plurality of padding panels 106 that are circumferentially positioned about the headband 100. In some embodiments, all of the padding panels 106 can be similar in configuration. Alternatively, one or more padding panels 106 can be configured differently than other padding panels 106. The headband 100 can include an impact panel 108. While FIGS. 2 and 4 depict an example configuration of the impact panel 108, this disclosure is not so limited. Instead, impact panels in accordance with the present disclosure can have any of a variety of suitable configurations, including various shapes, sizes, thicknesses, and curvatures. In some embodiments, the thickness of the impact panel is less than the thickness of the padding panels. The impact panel can be substantially rigid, such that its shape cannot easily be deformed. Alternatively, the impact panel can be at least semi-flexible or bendable, such that the impact panel can be curved or flexed, such as when the headband is placed on a wearer's head. Further, as shown, in accordance with various embodiments, the impact panel 108 can be shaped similarly to one of the padding panels 106, such as a central padding panel. The headband 100 can be worn by a user such that the impact panel 108 is generally facing forward and in proximity to the user's forehead. A padding panel 106 is positioned between the impact panel 108 and the user's forehead. As such, during sporting events in which the front of the user's head is impacted, by a ball or otherwise, the impact panel 108 can be impacted and the force from the impact can be distributed to the underlying padding panel 106.

Referring now to FIG. 3, adjacent padding panels 106 can be circumferentially spaced from one another to form gaps therebetween. In some embodiments, stitching, glue, ultrasonic welding, or other connection means can be applied in the gaps in order to secure portions of the outermost layer 102 in the gaps between the adjacent padding panels 106. For instance, the outermost layer 102 can have an outer portion that is outward facing and an inner portion that is inner facing. When worn by a wearer, the inner portion can be in contact with the wearer's head. Each of the inner portion and the outer portion can have an outer surface and an inner surface. The padding panels 106 can be positioned between the inner surface of the inner portion and the inner surface of the outer portion. When padding gaps are defined between adjacent padding panels 106, the inner surface of the outer portion can coupled to inner surface of the inner portion within one or more of the padding gaps. Beneficially, by stitching or otherwise connecting the outermost layer 102 in those areas, pockets can be formed that aid in maintaining the relative placement of each of the padding panels 106.

Figure 5:
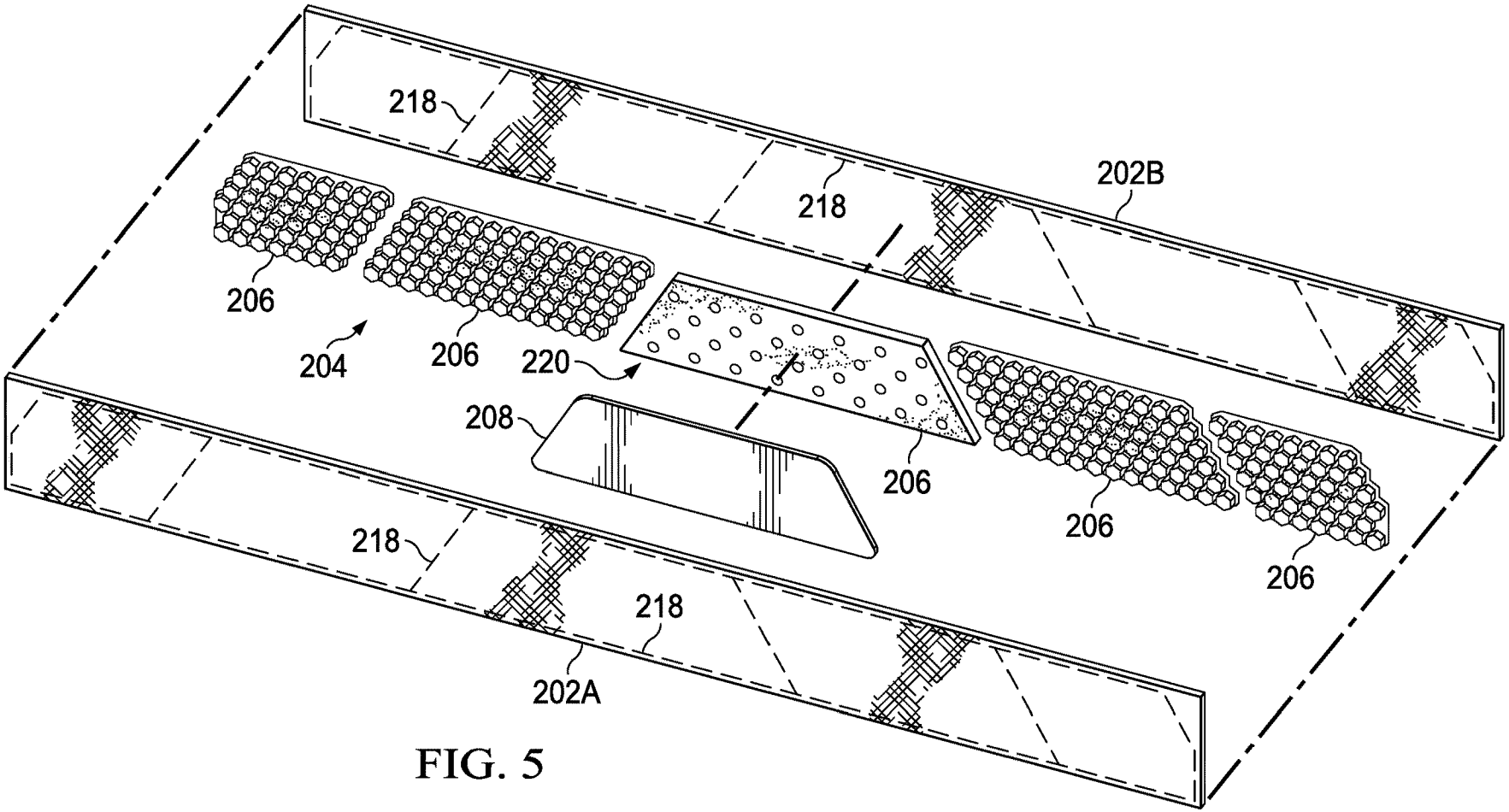
FIGS. 5-7 show exploded view of example headbands in accordance with various non-limiting embodiments.
Figure 6:
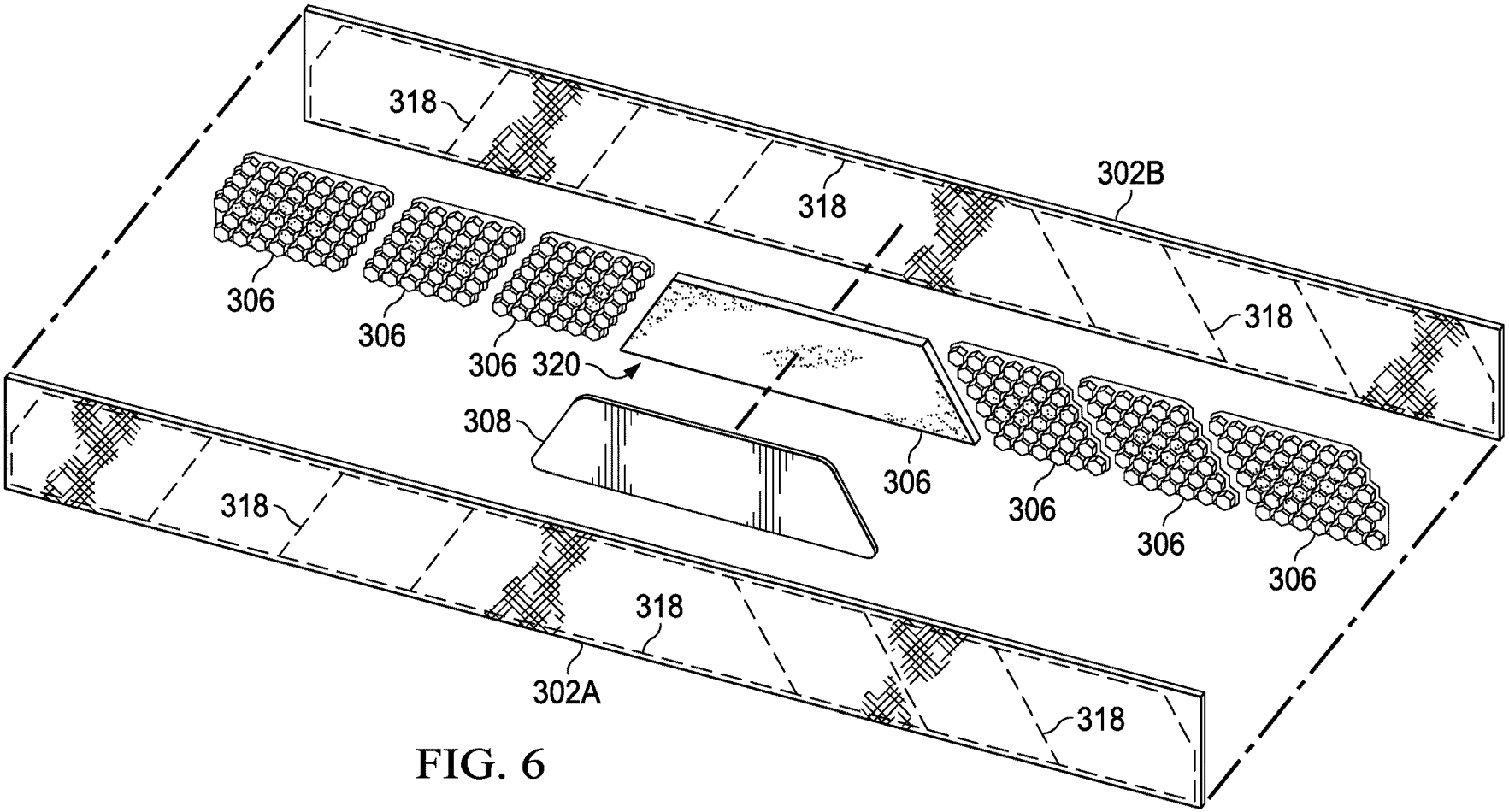
Figure 7:
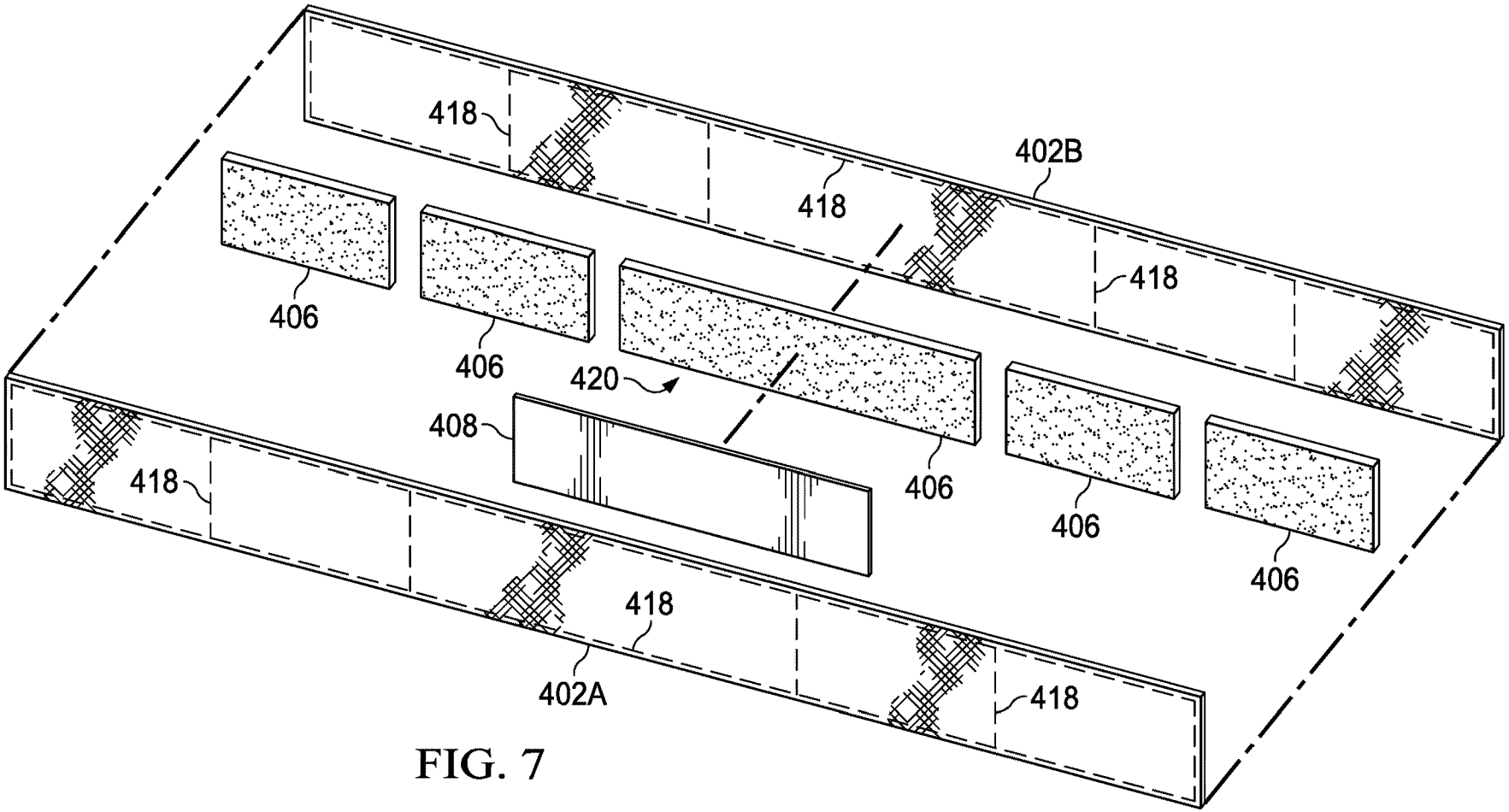

FIGS. 5-7 show exploded view of example headbands in accordance with various non-limiting embodiments. Referring first to FIG. 5, the headband includes an outside panel 202A and an inside panel 202B that can be stitched together using stitching 218. The stitching 218 can partially or wholly surround the individual panels 206 of the padding layer 204. In the illustrated embodiment, the central padding panel 220 is shaped generally similarly to an impact panel 208 such that they are generally coextensive. In the illustrated embodiment, the central padding panel 220 includes a plurality of apertures, although this disclosure is not so limited. The impact panel 208 can be coupled to the central padding panel 220 using an adhesive or other joining technique. In some embodiments, the impact panel 208 and the central padding panel 220 are not coupled to one another, but rather are both positioned in the same pocket that is formed by the outside panel 202A and the inside panel 202B. Furthermore, while FIG. 5 depicts the impact panel 208 and central padding panel 220 being positioned in a central pocket, and the remaining pockets only having a padding panel, this disclosure is not so limited. In fact, any pocket of the headband can house a padding panel only, an impact panel only, or at least one impact panel combined with at least one impact panel. In some embodiments, the headband defines five pockets, each of which holds a padding panel.

Referring now to FIG. 6, an exploded view of another example headband is shown. An outside panel 302A and an inside panel 302B are stitched together using stitching 318. The stitching 318 can partially or wholly surround the individual panels 306 of the padding layer 304. In the illustrated embodiment, the central padding panel 320 is shaped generally similarly to an impact panel 308. The impact panel 308 can be coupled to the central padding panel 320 using an adhesive or other joining technique. In some embodiments, the impact panel 308 and the central padding panel 320 are not coupled, but rather are both positioned in the same pocket formed by the outside panel 302A and the inside panel 302B.

Referring now to FIG. 7, an exploded view of another example headband is shown. An outside panel 402A and an inside panel 402B can be stitched together using stitching 418. The stitching 418 can partially or wholly surround the individual panels 406 of the padding layer 404. In the illustrated embodiment, the central padding panel 420 is shaped generally similarly to an impact panel 408. The impact panel 408 can be coupled to the central padding panel 420 using an adhesive or other joining technique. In some embodiments, the impact panel 408 and the central padding panel 420 are not coupled, but rather are both positioned in the same pocket formed by the outside panel 402A and the inside panel 402B.

FIG. 8 shows an impact panel 508 in accordance with one non-limiting embodiment. FIGS. 9-10 show the impact panel 508 of FIG. 8 in combination with an example padding panel 506 in accordance with one non-limiting embodiment. The impact panel 508 can be formed from any suitable rigid or semi-rigid material. In accordance with various embodiments, the impact panel 508 can be formed of, without limitation, a plastic material, styrofoam, a rigid foam, carbon fiber, polystyrene, or polycarbonate, for example. In some embodiments, the impact panel 508, while rigid, can still be flexed or bent such that it curves to match the head of the user. In other embodiments, the impact panel 508 can be formed to be non-flexible such that it perpetually maintains a desired curvature. FIG. 10 depicts the impact panel 508 can be curved to have a radius of curvature, shown as R. The radius of curvature can be dimensioned to be similar to the radius of curvature of a wearer's head.

Figure 11:
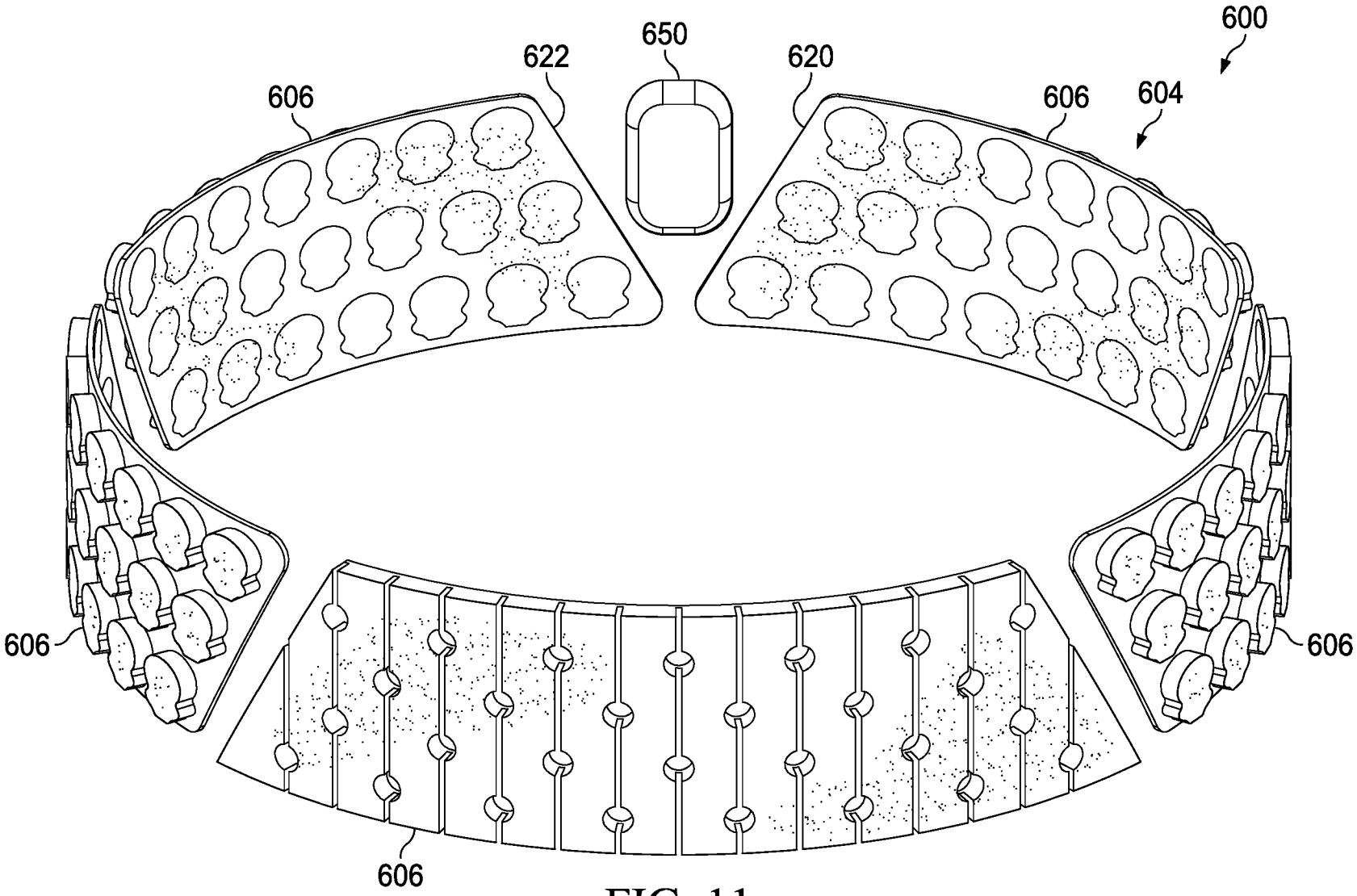
FIG. 11 shows an isometric view of a padding layer of an example headband in accordance with one non-limiting embodiment.

Referring now to FIG. 11, an isometric view of an example padding layer 604 of a headband 600 is shown. The padding layer 604 includes a plurality of padding panels 606. The padding layer 604 includes a gap that is defined by a first padding edge 622 and a second padding edge 620. The gap may be positioned generally in a rear of the headband 600 when worn by a wearer. In some embodiments, the gap is a V-shaped gap, tapering inward from top to bottom, although this disclosure is not so limited. A tracking system 650 can be positioned in the gap. The tracking system 650 can include one or more sensors to monitor, for example, speed, location, impact, temperature, among other parameters. The tracking system 650 can be positioned, for example, in a pocket or compartment defined by the headband 600. In some embodiments, the pocket or compartment is defined by an outermost layer of the headband 600. The tracking system 650 can, for example, provide data to a remote computing device, such as a mobile device, tablet, smart watch, or the like. Through the use of a tracking system 650 high risk athletes or those being over exposed to impacts or training loads can be identified. Additionally, performance-based metrics, including top speed, distance traveled, body angle and acceleration, as well as other metrics, can be tracked and logged. Additionally or alternatively, other types of tracking systems can be utilized, including tracking systems that include sensors embedded in the fabrics or yard of the headband, sensors added to the padding panels, among a variety of other sensing techniques.

Figure 12:
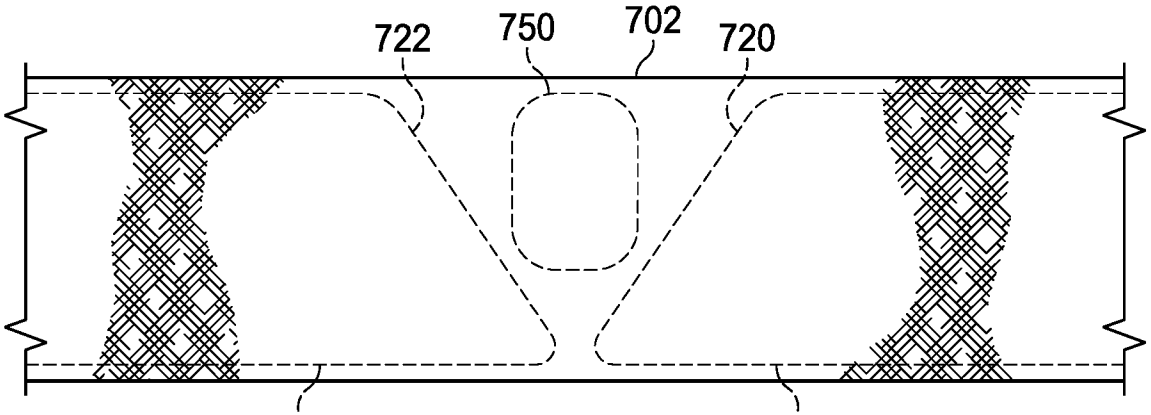
FIGS. 12-13 are partial views of example headbands in accordance with various non-limiting embodiments.
Figure 13:
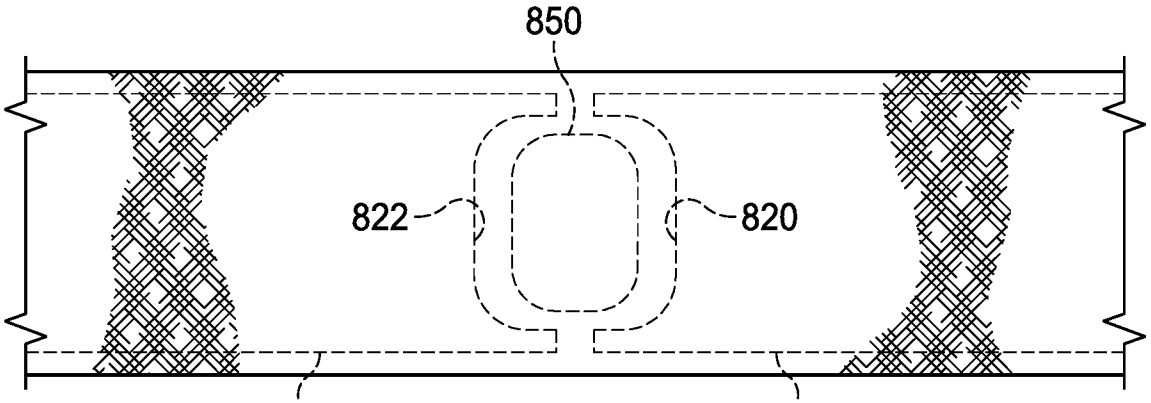

FIGS. 12-13 are partial views of example headbands in accordance with various non-limiting embodiments. FIG. 12 depicts a tracking system 750 positioned between two adjacent padding panels 706. The padding panels 706 define a gap between a first padding edge 722 and a second padding edge 720. The tracking system 750 is positioned in that gap. FIG. 13 depicts a tracking system 850 positioned between two adjacent padding panels 806. The padding panels 806 define a gap between a first padding edge 822 and a second padding edge 820. The tracking system 850 is positioned in that gap.

Figure 14:
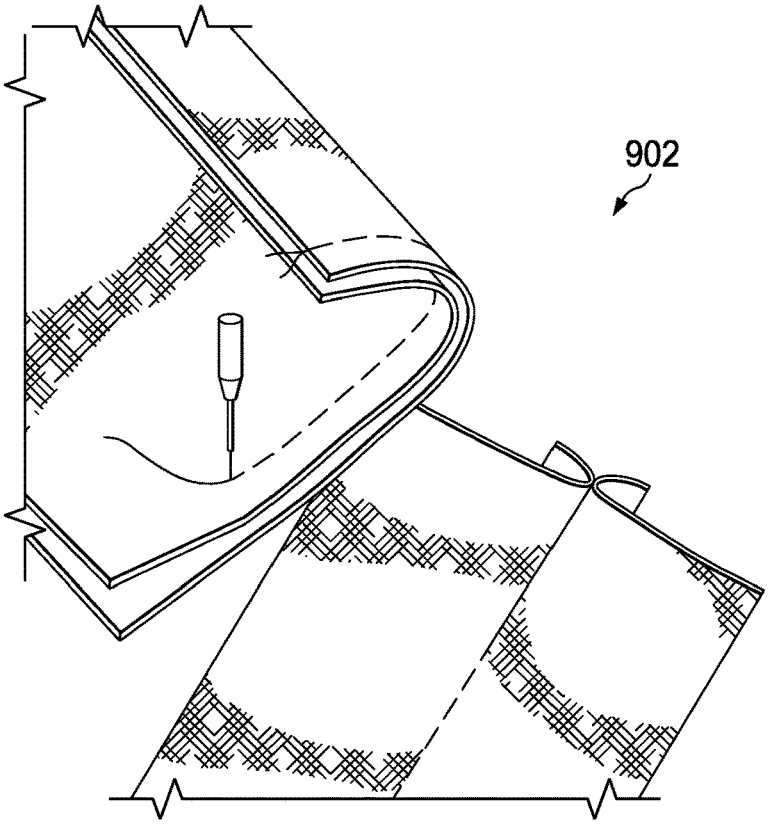
FIGS. 14-15 depict example stitching techniques in accordance with various non-limiting embodiments.
Figure 15:
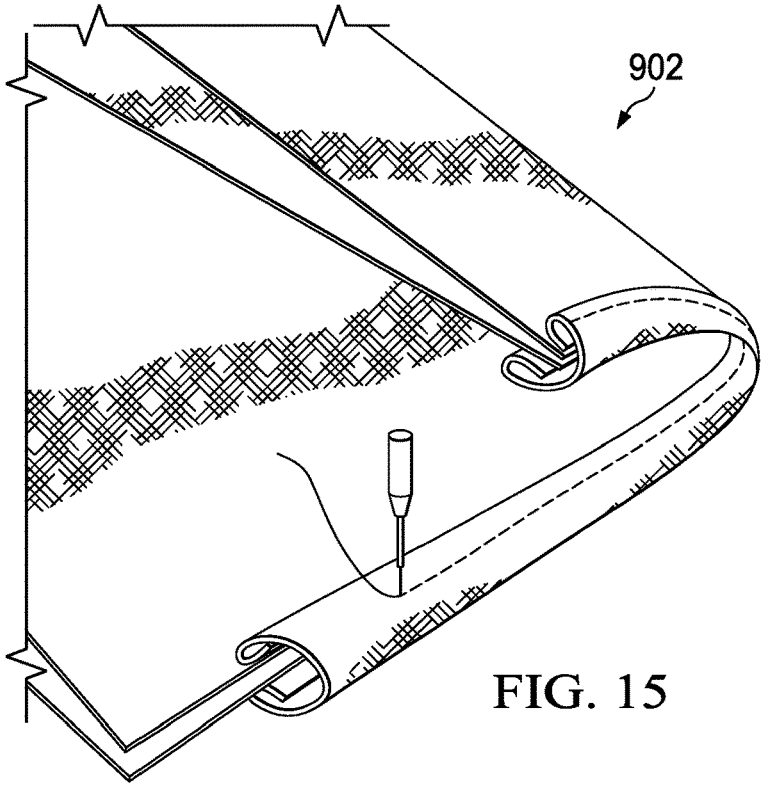

FIGS. 14-15 depict example stitching techniques in accordance with various non-limiting embodiments. Such stitching techniques can be used, for example, to stitch an outside panel to an inside panel, similar to the outside panel 202A and an inside panel 202B shown in FIG. 5, for example, to form an outermost layer 902. The outside panel and inside panel can be stretchable, or otherwise have stretchable areas, that allow the headband to flex and expand when placed on a user's head. As provided below, in some embodiments, the outside panel and the inside panel include spandex. In some embodiments, each of the padding panels is disconnected from both the outside panel and the inside panel. In some embodiments, one or more of the padding panels is coupled to one or both of the outside panel and the inside panel.

The padding layer utilized by headbands in accordance with the present disclosure can be comprised of any suitable material that provides the desirable characteristics and response to impact. For example, the padding layer can comprise one or more of the following materials: thermoplastic polyurethane (available, for example, from Skydex Technologies), military-grade materials, impact absorbing silicone, D30® impact absorbing material, impact gel, wovens, non-wovens, cotton, elastomers, IMPAXX® energy-absorbing foam (available from Dow Automotive), DEFLEXION shock absorbing material (available from Dow Corning), styrofoam, polymer gels, general shock absorbing elastometers, visco-elastic polymers, PORON® XRD impact protection (available from Rogers Corporation), SMARTFOAM material (available from XONano® in partnership with Rogers Corporation), Sorbothane® (available from Sorbothane Inc.), Neoprene (available from DuPont), Ethyl Vinyl Acetate, impact-dispersing gels, foams, rubbers, and so forth. The padding layer can be breathable and/or generally porous to provide ventilation. In some embodiments, the padding layer is a mesh material that aids in the breathability of the associated headband. As provided above, the padding layer can be attached to one or more layers. In some embodiments, the padding layer can be generally disconnected and "floating" between the layers.

In some embodiments, padding layers in accordance with the present systems and methods can comprise a rate dependent material, such as a rate dependent low density foam material. Examples of suitable low density foams include polyester and polyether polyurethane foams. In some embodiments, such foams to have a density ranging from about 5 to about 35 pounds per cubic foot (pcf), more particularly from about 10 to about 30 pcf, and more particularly still from about 15 to about 25 pcf. PORON® and PORON XRD® are available from Rogers Corporation, which are open cell, microcellular polyurethane foams, is an example of one suitable rate dependent foam. However, in order to provide impact resistance, the padding layer can be any suitable energy absorbing or rate dependent materials. As such, other rate dependent foams or other types of materials can be used without departing from the scope of the present disclosure.

The other layers of headbands in accordance with the present disclosure can either be the same material or different material. The material can be, for example, and without limitation, polyester, nylon, spandex, ELASTENE (available from Dow Chemical), cotton, materials that glow in the dark or are fluorescent, and so forth. Either of the inner or outer layers can also be of a mesh or otherwise porous material. In some embodiments, the inner and/or outer layers can be a blend of a variety of materials, such as a spandex/polyester blend. In some embodiments, the headband is water proof, water resistant, or water repellant. Other durable materials can be used for the outer layer of any embodiment, including knit, woven and nonwoven fabrics, leather, vinyl or any other suitable material. In some instances, it can be desirable to use materials for the layer than are somewhat elastic; therefore, stretchable fabrics, such as spandex fabrics, can be desirable. Such materials can help provide compressive forces to maintain placement of headband on a wearer's head.

Various headbands in accordance with the systems and methods described herein can be manufactured with or otherwise include various coatings, agents, or treatments to provide anti-microbial or anti-bacterial properties. Some embodiments, for example, can utilize Microban® offered by Microban International, Ltd. for antibacterial protection. In some embodiments, the padding layer comprises antimicrobial agents and one or more other fabric layers of the headband also treated with antimicrobial agents. Antimicrobial protection for the fabric layers can be in the form of a chemical coating applied to the fabric, for example. Generally, antimicrobial technologies combat odor by fighting bacteria resulting in fresher smell for longer and minimizing the frequency of laundering or washing. Any suitable technique can be used to provide headbands with antimicrobial properties. In one embodiment, for example, AEGIS Microbe Shield® offered by DOW Corning Corp. is utilized. Other examples of antimicrobial agents include SILVADUR® offered by The Dow Chemical Company is utilized, Smart Silver offered by NanoHorizons, Inc., and HealthGuard® Premium Protection offered by HealthGuard.

In some embodiments, a headband, or at least various components of a headband are configured to provide moisture wicking properties. Generally, moisture wicking translates into sweat management, which works by removing perspiration from the skin in an attempt to cool the wearer. Any suitable moisture wicking can be used. In one embodiment, a topical application of a moisture wicking treatment to a fabric of the headband is utilized. The topical treatment is applied to give the headband the ability to absorb sweat. The hydrophilic (water-absorbing) finish or treatment generally allows the headband to absorb residue, while the hydrophobic (water-repellent) fibers of the headband help it to dry fast, keeping the wearer more comfortable. In one embodiment, the blend of fiber is used to deliver moisture wicking properties by combining a blend of both hydrophobic (such as polyester) with hydrophilic fibers. Certain blends of these fibers allow the hydrophilic fibers to absorb fluid, moving it over a large surface area, while the hydrophobic fibers speed drying time. One benefit of headbands utilizing these types of fiber blends is that moisture management properties are inherent in the fiber blend, meaning they will never wash or wear out.

Headbands in accordance with the presently disclosed embodiments may be manufactured using a variety of manufacturing techniques, such as ultrasonic welding, stitching, gluing, and/or quilting, for example. Additionally, or alternatively, additive manufacturing and/or 3D printing processes can be utilized. Stitching can be used to couple an interior fabric layer to an external fabric layer to create a pocket to house the padding layer. In some embodiments, double needle stitching is utilized to attach various components of the headband. With a double stitching technique, twin needles create parallel double stitching using two needles mounted in a plastic holder. A standard needle shank is added to the plastic holder so it can be inserted in the needle holder on the sewing machine. One needle can be shorter than the other so that a bobbin can catch both stitches. The headbands can be manufactured in different sizes so that they can accommodate both children head sizes and adult head sizes.

The particular combination of materials for the various layers of headbands manufactured in accordance with the systems and methods described herein can vary. Below are some non-limiting examples of material combinations. As is to be readily appreciated, other combinations are envisioned and are within the scope of the present disclosure. For some headbands, one or more layers can comprise about 80-90% polyester or Nylon and about 10-20% Spandex or Elastene. In one embodiment, one or more layers can comprise about 86% polyester and about 14% Spandex. One or more layers can also be a mesh-type material for increased breathability and ventilation. The layers of the headband can have various fabric weights. In some embodiments, the fabric weight of an outer or inner lay can be in the range of about 5 to about 12 ounces, for example.

In some embodiments, one or more of the fabric layers can comprise about 60% polyester and about 40% cotton. In one embodiment, one or more fabric layers can comprise about 100% cotton. In one embodiment, one or more fabric layers can comprise about 80% polyester and about 20% spandex. In one embodiment, one or more fabric layers can comprise about 90% polyester and about 10% Spandex. In one embodiment, one or more fabric layers can comprise about 86% polyester and about 14% Spandex. In some embodiments, one or more fabric layers can comprise about 100% acrylic. In one embodiment, one or more layers can comprise about 85% acrylic and about 15% nylon.

In some embodiments, one or more fabric layers can comprise about 100% cotton. In one embodiment, one or more fabric layers can comprise about 80% cotton and about 20% polyester. Furthermore, various headbands can be manufactured from colored materials, dyed particular colors, or manufactured with glow in the dark and/or reflective materials.

In various embodiments disclosed herein, a single component may be replaced by multiple components and multiple components may be replaced by a single component to perform a given function or functions. Except where such substitution would not be operative, such substitution is within the intended scope of the embodiments. While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

What is claimed is:

1. A headband, comprising:

an outermost layer, wherein the outermost layer defines a circular opening to accept a head of a wearer, wherein the outermost layer comprises an outer facing portion, and an inner facing portion, wherein the inner facing portion is positioned to directly contact a head of a wearer, and wherein the outermost layer defines a plurality of circumferentially-spaced pockets;

a plurality of padding panels, wherein a respective one of the plurality of padding panels is positioned within a respective one of each of the plurality of circumferentially-spaced pockets, wherein a first of the plurality of padding panels defines a first padding edge, wherein a second of the plurality of padding panels defines a second padding edge, wherein the first padding edge is positioned adjacent to the second padding edge, and wherein the first padding edge and the second padding edge collectively define a tapered padding gap therebetween; and an impact panel, wherein the impact panel is positioned within a forward-facing pocket, wherein the forward-facing pocket is one of the plurality of circumferentially-spaced pockets, and wherein the impact panel is positioned between the outer facing portion and the respective one of the plurality of padding panels positioned within the forward-facing pocket.

2. The headband of claim 1, the wherein the outermost layer defines a total of five circumferentially-spaced pockets.

3. The headband of claim 2, wherein each of the plurality of circumferentially-spaced pockets are defined by stitching of the outer facing portion to the inner facing portion.

4. The headband of claim 1, wherein the respective one of the plurality of padding panels positioned within the forward-facing pocket has a first thickness and the impact panel has a second thickness, wherein the first thickness is greater than the second thickness.

5. The headband of claim 1, wherein the respective one of the plurality of padding panels positioned within the forward-facing pocket is coupled to the impact panel.

6. The headband of claim 1, wherein the respective one of the plurality of padding panels positioned within the forward-facing pocket is disconnected from the impact panel.

7. The headband of claim 1, wherein the impact panel is at least partially formed from any of a plastic material, Styrofoam, a rigid foam, carbon fiber, polystyrene, and polycarbonate.

8. The headband of claim 1, wherein the impact panel has a radius of curvature.

9. The headband of claim 1, further comprising a non-slip feature coupled to the inner facing portion.

10. The headband of claim 9, wherein the non-slip feature comprises a silicone band.

11. The headband of claim 1, further comprising an electronic tracking system positioned between the first padding edge and the second padding edge, wherein the electronic tracking system comprises at least one sensor.

12. The headband of claim 11, wherein the least one sensor generates an output responsive to speed, impact, or temperature.

13. The headband of claim 1, wherein the outermost layer comprises an outer fabric layer stitched to an inner fabric layer, wherein the outer fabric layer defines the outer facing portion and the inner fabric layer defines the inner facing portion.

14. A headband, comprising:

an outer fabric layer, an inner fabric layer, wherein the inner fabric layer is stitched to the outer fabric layer to collectively define an outermost layer, wherein the outermost layer defines a circular opening to accept a head of a wearer, wherein the inner fabric layer is positioned to directly contact a head of a wearer, and wherein the inner fabric layer and the outer fabric layer collectively define a plurality of circumferentially-spaced pockets, wherein the plurality of circumferentially-spaced pockets comprises a forward-facing pocket;

a plurality of padding panels, wherein a respective one of the plurality of padding panels is positioned within a respective one of each of the plurality of circumferentially-spaced pockets, wherein a first of the plurality of padding panels defines a first padding edge, wherein a second of the plurality of padding panels defines a second padding edge, wherein the first padding edge is positioned adjacent to the second padding edge, and wherein the first padding edge and the second padding edge collectively define a tapered padding gap therebetween; and an impact panel, wherein the impact panel is positioned within the forward-facing pocket, and wherein the impact panel is positioned between the outer fabric layer and the respective one of the plurality of padding panels positioned within the forward-facing pocket.

15. The headband of claim 14, the wherein the outermost layer defines a total of five circumferentially-spaced pockets.

16. The headband of claim 14, wherein the respective one of the plurality of padding panels positioned within the forward-facing pocket is adhered to the impact panel.

17. The headband of claim 14, wherein the respective one of the plurality of padding panels positioned within the forward-facing pocket is disconnected from the impact panel.

18. The headband of claim 14, wherein the impact panel is at least partially formed from any of a plastic material, Styrofoam, a rigid foam, carbon fiber, polystyrene, and polycarbonate.

19. The headband of claim 14, further comprising a non-slip feature coupled to the inner facing portion.

20. A headband, comprising:

an outer fabric layer, an inner fabric layer, wherein the inner fabric layer is stitched to the outer fabric layer to collectively define at least five pockets, wherein one of the at least five pockets is a forward-facing pocket;

a plurality of padding panels, wherein a respective one of the plurality of padding panels is positioned within a respective one of each of the at least five pockets, wherein a first of the plurality of padding panels defines a first padding edge, wherein a second of the plurality of padding panels defines a second padding edge, wherein the first padding edge is positioned adjacent to the second padding edge, and wherein the first padding edge and the second padding edge collectively define a tapered padding gap therebetween; and an impact panel, wherein the impact panel is positioned within the forward-facing pocket, wherein the impact panel is positioned between the outer fabric layer and the respective one of the plurality of padding panels positioned within the forward-facing pocket, wherein the impact panel has an outline shape that is substantially similar to an outline shape of the respective one of the plurality of padding panels positioned within the forward-facing pocket, and wherein the impact panel is at least partially formed from any of a plastic material, Styrofoam, a rigid foam, carbon fiber, polystyrene, and polycarbonate.

* * * * *